United States Patent [19]

Burke et al.

[11] 3,981,313

[45] Sept. 21, 1976

[54] HAIR DRYER CONCENTRATOR

[75] Inventors: Frederick A. Burke, Riverside; Douglas A. Long, Wilton, both of Conn.

[73] Assignee: Clairol Incorporated, New York, N.Y.

[22] Filed: Apr. 28, 1975

[21] Appl. No.: 572,081

[52] U.S. Cl. ..... 132/9; 34/97

[51] Int. Cl.[2] ..... A45D 1/00

[58] Field of Search ..... 132/9, 120, 121, 122, 132/129, 11 R; 15/402; 34/97

[56] References Cited

UNITED STATES PATENTS

| | | | |
|---|---|---|---|
| 1,859,132 | 5/1932 | Fechtenburg | 15/402 |
| 2,446,424 | 8/1948 | Kline | 132/122 |
| 3,890,985 | 6/1975 | Hicks | 132/9 |

*Primary Examiner*—G.E. McNeill

*Attorney, Agent, or Firm*—Sherman & Shalloway

[57] ABSTRACT

A concentrator for airflow hair dryers having a comb or similar attachment mounted within the air outlet and selectively positionable in multiple positions to precede the airflow, follow the airflow, or to divide the airflow discharging from the concentrator outlet.

10 Claims, 7 Drawing Figures

HAIR DRYER CONCENTRATOR

BACKGROUND OF THE INVENTION

The present invention relates to hand-held hair dryers and is concerned more particularly with concentrator attachments for control and concentration of the heated air discharging from such hair dryers and attachments for such concentrators to engage and manipulate the hair selectively preceding, succeeding, or both, simultaneously with the application of the heated air against the wet hair.

BRIEF DESCRIPTION OF THE PRIOR ART

A variety of hand-held dryers are available and have enjoyed considerable popularity in both professional hair salons and home hair care.

Also, it is known that a combing action, in conjunction with the application of heat, not only facilitates the drying operation by mechanical sweeping of water therefrom, but also by manipulation of the air strands in relation to each other and to the scalp, thereby agitating the hair to expose differing areas and increasing the effective area available to the heated air.

Typically, such simultaneous combing and heated-air drying was effected with two hands, each holding either the comb or the hair dryer. While this was effective in salons and in the hands of a second person, it was quite clumsy for a person attempting to dry and comb their own hair. The system not only is clumsy because of the need for a frequent exchange of the dryer and comb, to change the direction of the work being done, but is extremely tiring, since neither arm is free to rest an any point in the procedure.

An attempt to solve this problem involved the mounting of a comb on the hair dryer at the terminal outlet of the heated air. However, with a fixed comb, or a comb which is fixed in relation to the heated-air flow, there is a considerable forfeit of the techniques which were formerly possible with the separate hair dryer and comb units. Such units do not permit a change in the relationship of the comb and the airflow, so that the effect of the comb, with regard to the location and effect of the airstream, was limited and a compromising expedient, rather than an improvement which retained the versatility of the prior, separate comb-and-hair dryer practice.

Therefore, prior hair dryers have not been found to be entirely satisfactory.

SUMMARY OF THE INVENTION

In general, the preferred form of the present invention comprises a concentrator attachment for hand-held, heated-air hair dryers. The concentrator includes pivot means for pivotally mounting a comb or other hair engaging attachment thereon in the terminal heated-air outlet and locking means for locking the comb attachment in a plurality of selected positions with regard to the terminal heated-air outlet. Preferably, the pivot means includes a resilient release for the comb attachment to permit removal, exchange and replacement of the combing attachment.

OBJECTS OF THE INVENTION

An object of the present invention is the provision of a hair grooming attachment for heated-air, hand-held dryers which permits the use of varied techniques in the use of the hair dryer.

Another object of the present invention is the provision of a concentrator for hand-held hair dryers and having a comb which may be used for different techniques of detangling, drying, straightening and styling.

Another object of the present invention is the provision of a concentrator for hand-held hair dryers and having a comb attachment mountable to comb preceding the flow of heated air being discharged from the concentrator.

A further object of the present invention is the provision of a concentrator for hand-held hair dryers and having a comb attachment mountable to comb following the flow of heated air being discharged from the concentrator.

A still further object of the present invention is the provision of a concentrator for hand-held hair dryers and having a comb attachment mountable to comb intermediate and within the flow of heated air being discharged from the concentrator.

A particular object of the present invention is the provision of a concentrator for hand-held hair dryers and having a comb attachment mountable therein in a plurality of positions to comb selectively preceding, following or dividing the flow of heated air from the terminal outlet of the concentrator.

A further particular object of the present invention is the provision of a concentrator accessory for hand-held hair dryers and having a grooming attachment pivotally mountable thereon for quick and convenient reorientation to permit use of the grooming attachment selectively preceding, following or dividing the flow of heated air from the terminal outlet of the concentrator.

A still further particular object of the present invention is the provision of a concentrator accessory for hand-held hair dryers and having means for mounting interchangeable attachments in readily changeable positions in and with regard to the terminal outlet for the discharge of heated air therefrom.

Another particular object of the present invention is the provision of a concentrator accessory for hand-held hair dryers which achieves the foregoing and other objects of the invention in a concentrator which is lightweight and economical and a major portion of which is capable of being molded in one piece from a suitable plastic material.

BRIEF DESCRIPTION OF THE DRAWINGS

These and other objects of the present invention may be more readily derived from the following description and the accompanying drawings in which.

DETAILED DESCRIPTION OF THE PREFERRED EMBODIMENT

Figure 1:
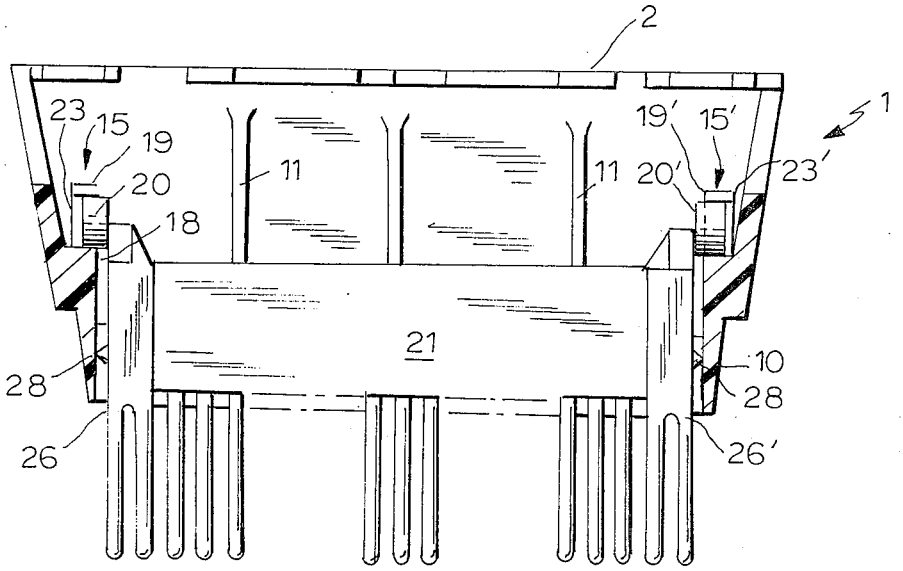
FIG. 1 is a sectional side view of the preferred embodiment of the concentrator of the present invention.
Figure 2:
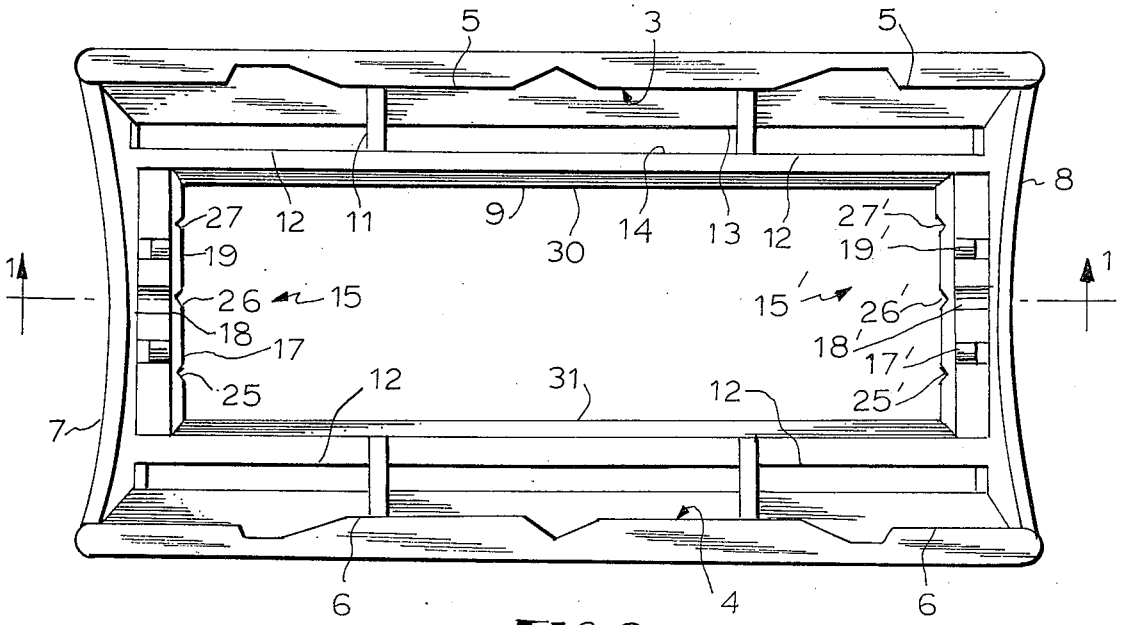
FIG. 2 is a plan view of the concentrator of FIG. 1.

As shown in the drawings, the preferred form of concentrator accessory is adapted for use with an electrically-operated, hand-held dryer having a rectangular heated-air discharge. Hair dryers of this type are well known and are available in various types and qualities.

It is to be understood that the new concentrator of the present invention may be adapted for use with a variety of hand-held hair dryers, whether intended for professional salons or for home use.

The preferred form of concentrator accessory comprises a housing body 1 having a rectangular inlet 2 for receiving heated air from the dryer. The longitudinal edges 3 and 4 of the inlet 2 are provided with suitable series of mounting lips 5 and 6, respectively, for snap-locking the edges in sealing engagement on the housing of the hair dryer. The end walls 7 and 8 each have curved edges for mating with and closing against the exterior or other suitable portion of the hair dryer housing.

The concentrator housing 1 preferably is molded in one piece and generally tapers inwardly toward a terminal discharge outlet 9 in a reduced body portion 10 which is joined with the main body portions at the end walls and by transverse portions of reinforcing ribs 11. The ribs 11 define a plurality of intermediate outlet apertures 12, of smaller size, intermediate the inlet 2 and outlet 9 on each side of the housing between the adjacent edges 13 and 14, respectively, of the main body portion 1 and the reduced portion 10.

Internally of the housing, the end walls 7 and 8 each carry a pivot socket 15 and 15', respectively. The pivot sockets are aligned with each other, preferably substantially upon the longitudinal centerline of the housing body 1. The sockets 15 and 15' are similar and only one will be described in detail, for simplicity, the components of the socket 15' being identified by the same numerals, primed, as those of socket 15.

The pivot socket 15 is formed of three parallel socket members 17, 18 and 19 molded on the endwall 7 and spaced from each other transversely of the housing to accept a rounded pivot 20 of a hair-engaging and manipulating attachment such as the comb 21 shown in the drawings.

The resilient outer socket members 17 and 19 preferably have arcuate or semi-circular recesses 22 and 23, respectively, which are aligned opposite each other to provide a semi-circular surface portion for receiving the pivot 20. The upper portions of the socket members 17 and 19 are separated from their respective end walls, during molding, so that they are free to spring away from each other sufficiently to accept and release the full diameter of the pivot 20, between their respective ends 24 and 25, as it is pressed toward and out of the semi-circular recesses 22 and 23.

The semi-circular recesses preferably are curved on a common radius generally equal to, or slightly greater than the radius of the pivot 20, thereby allowing the ends 24 and 25 to snap back to their original position to retain the pivot resiliently trapped therebetween. The upper surface of the fixed intermediate socket member 18 preferably carries a curved recess **18*a* formed on the same radius as the recesses 22 and 23 to provide a three-point, arcuate bearing of the pivot socket 15 on the pivot 20**.

Intermediate the pivot socket 15 and the terminal discharge outlet 9, the endwall 7 of the reduced body portion 9 is provided with a thickened portion 16 with three elongated, V-shaped, parallel detents 25, 26, and 27 for receiving a boss 28 on the comb 21.

Figure 3:
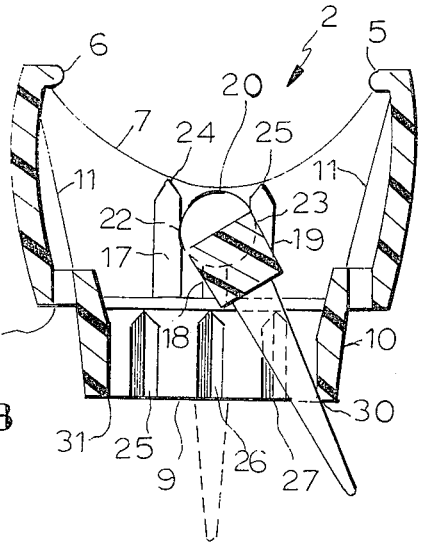
FIG. 3 is a cross-sectional view taken on lines 3—3 of FIG. 1.
Figure 6:
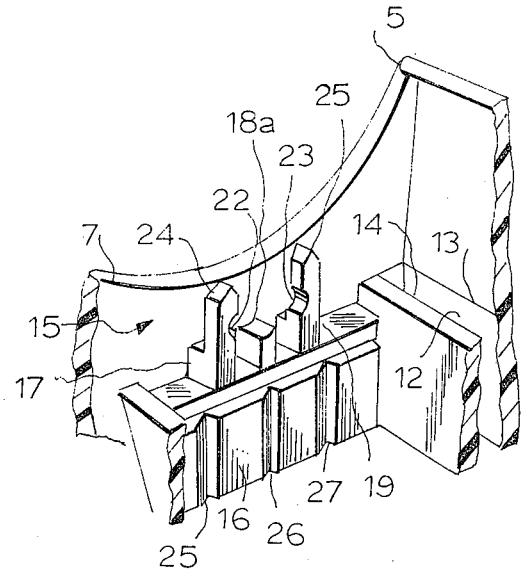
FIG. 6 is a perspective view of an inner end portion of the concentrator housing showing the pivot socket.

The detent 26 is positioned on a line passing through the axis of the pivot socket 15 and transversely bisecting the terminal discharge outlet 9, as is the fixed socket member 18. Therefore, when an attachment such as the comb 21 is mounted in the concentrator with its pivots 20 and 20' in the pivot sockets 15 and 15' and its bosses 28 and 28' entered in the detents 26 and 26', the body and teeth of the comb bisect the reduced body portion 10 and the terminal discharge outlet 9 on its longitudinal center line, as shown in dotted lines in FIGS. 3 and 4.

Figure 4:
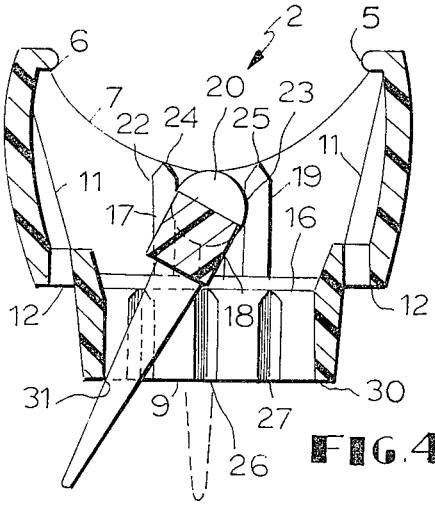
FIG. 4 is a cross-sectional view similar to FIG. 3 and showing the comb attachment in a different position.
Figure 5:
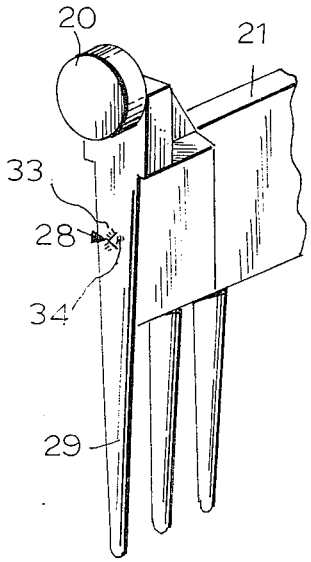
FIG. 5 is a perspective view of an end of the comb attachment showing the pivot and locking points thereon.

The detents 25 and 27 each are positioned away from the longitudinal center line and closer to their respective, adjacent longitudinal edges of the terminal discharge outlet 9. The comb, therefore, when mounted in the pivot sockets 15 and 15' and with its bosses 28, 28' in the detents 27 and 27', is securely mounted with its teeth 29 against or closely adjacent to the longitudinal edge 31, as shown in FIG. 4. If, on the other hand, the detents 28 and 28' were relocated into the detents 25 and 25', the teeth 29 would then be mounted against or closely adjacent the longitudinal edge 30.

It is preferable to form the bosses 28, 28' with an apex or, at least, with lateral surface 33 and 34 at an angle to facilitate rotation of the comb or other attachment to disengage the bosses 28, 28' from one of the detents for rotational repositioning of the attachment to another position and securement by another of the detents. Such bosses may take generally pyramidal or conical form, for example in addition to the wedge-shape shown. This is particularly important where hair-engaging attachments of lesser strength are to be used, as in the case of brushes or thin-tined rakes or lifters.

It is to be understood that, although the preferred concentrator incorporates three detents for the positioning of a grooming accessory, the actual number of detents is not critical to the invention. Accordingly, a different number of detents, or differing transverse positioning thereof, may be employed to afford intermediate positions of an attachment and differing divisions of the heated-air flow through the terminal discharge outlet.

It is important to the present invention that the concentrator be formed from a material which is both tough and light in weight and, particularly, is capable of being molded to form a unitary structure. One such material, for example, would be a polycarbonate such as that currently marketed as number 141-R, under the Trademark "LEXAN", by the General Electric Company. This material is equally suitable for forming the comb or the concentrator-engaging portion of the grooming attachments.

The preferred form of concentrator is quite readily molded with its housing, pivot sockets and detents forming a single molded unit. Since the socket members 17, 18 and 19 and the detents 25, 26 and 27 are all substantially parallel to each other, they are quite easily incorporated as a molded, integral part of the housing. This not only simplifies the mold requirements, but also facilitates removal of the units from the mold.

OPERATION OF THE PREFERRED EMBODIMENT

Figure 7:
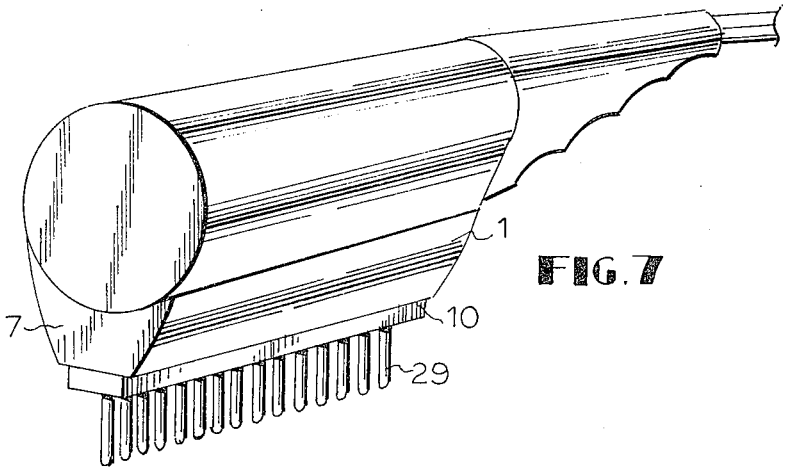
FIG. 7 is a perspective view showing the concentrator in place on a hair dryer.

In use, the selected comb or other grooming attachment is installed in the concentrator 1 and the unit is then mounted on the hair dryer for which it was designed, as represented schematically in FIG. 7.

With hair that has just been washed, the concentrator of the present invention permits the selection of a relatively coarse, de-tangling comb and, more importantly, the mounting of the comb against one of the edge 30 or 31 to position the comb teeth 29 following the heated-air flow.

With the comb teeth following the heated air flow, the hair is exposed to the drying effect ahead of the comb, and is less swollen by moisture at the time it is engaged by the teeth. This reduces the high coefficient of friction typical of wet hair and reduces the high coefficient of friction typical of wet hair and greatly facilitates the detangling of the hair as well as its drying.

The selection of the side toward which the comb is angled will depend, of course, on which hand is to be used for the grooming and drying step.

It is usual, when a person is grooming or drying their own hair, to change hands for different sides of the head or for a differing direction of grooming. Accordingly, if the comb is initially positioned adjacent the longitudinal edge 31, for right-hand use, it is desirable that it be repositioned adjacent the longitudinal edge 30 for use in the left hand.

The switching of the comb attachment from one position to another is readily accomplished as the unit is changed from one hand to the other. The combing attachment is simply grasped and rotated toward the desired position, thereby disengaging the tapered bosses 28 and 28' from the detents they formerly occupied. When the desired position has been reached, by further rotation of the comb, bosses 28 and 28' are then reseated in the porper detents and hold the comb in that position.

When the hair has been sufficiently dried that it is capable of being formed and styled, it is most effective to have the heated air impinge following a fine comb in its direction of travel. This heats the hair while it is under the tension imposed by the comb and considerably enhances the forming effect of the comb.

To this purpose, the concentrator of the present invention is capable of receiving and mounting a finer comb than that used for initial drying and de-tangling. The pivots 20 and 20' of the first comb are than snapped out of the resilient arms 17–19 and 17'–19' of the pivot sockets 15 and 15', and the newly selected, finer tooth comb is installed in the concentrator.

In use for styling and forming, the fine comb is rotated and positioned so that its teeth are adjacent whichever of the longitudinal edges 30 or 31 will form the leading edge of the terminal outlet 9. The heated-air flow thus meets the hair while it is under the tensions imposed by the manipulating effect of the comb teeth, so that the hair is heated under tension.

Again, when it is desired to change hands or to change the direction of the grooming strokes, the concentrator of the present invention provides for the quick rotation of the comb and its mounting in the newly selected position adjacent the other longitudinal edge.

The new concentrator is also of distinct advantage when it is desired to touch up or reform the hair between shampoos and apart from only a drying operation. The combination of heat under tension and the selectively variable relationship between the heated air flow and the teeth of the grooming attachment provides a reforming capability which is particularly advantageous.

Since the concentrator of the present invention supplies the heated air immediately adjacent the grooming device, the hair is subject to optimum temperature control as it is engaged and worked by the grooming unit, and is quite easily dried or reformed and styled.

whenever the bulk of the hair may happen to temporarily block the terminal outlet 9, the intermediate outlet apertures 12 provide means of escape for the airflow to avoid overheating of the hair dryer elements, which would otherwise result in damge to the dryer unit or tripping of a safety element.

Therefore, it is apparent that the concentrator of the present invention has unique capabilities and advantages not heretofore available in a unit capable of use with one hand. Moreover, the present invention provides a close association of the heated-air flow with the comb, or other hair engaging attachment, and a versatility in that close association which exceeds the potential of prior, two-handed techniques.

Furthermore, the present invention has achieved these capabilites and advantages in a concentrator which easily is molded with its housing, attachment-mount and attachment-positioning elements formed in a single molded unit.

Various changes may be made in the details of the invention, as described, without sacrificing the advantages thereof or departing from the scope of the appended claims.

The claims are:

1. A concentrator for airflow hair dryers comprising
a housing having
an inlet and
a terminal outlet for a flow of air therethrough, said terminal outlet being of a size less than said inlet,
a hair-engaging member,
means for mounting said hair-engaging member adjacent said terminal outlet, and
positioning means for selectively positioning said hair engaging member in plural hair-engaging positions in relation to said terminal outlet.

2. A concentrator as set forth in claim 1 in which said hair-engaging member is positioned at least partly within said terminal outlet, and at least one intermediate outlet in said housing.

3. A concentrator as set forth in claim 2 in which said positioning means comprises pivot means including a pair of opposed pivot sockets in said housing and a pair of pivot members on said hair-engaging member.

4. A concentrator as set forth in claim 3 in which the pivot sockets each include a pair of spaced resilient members.

5. A concentrator as set forth in claim 4 in which said resilient members have opposed recesses, positioned to receive a pivot member therebetween and a fixed member intermediate said resilient members and positioned to engage a portion of said hair-engaging member.

6. A concentrator as set forth in claim 5 in which said positioning means includes detent means in said housing, said detent means including a plurality of detents spaced from said pivot sockets and from each other, and at least one detent member on said hair-engaging member positioned to engage said detents.

7. A concentrator as set forth in claim 6 in which said pivot members are circular, said fixed member of each pivot socket each has an arcuate recess, said recesses in said resilient members are arcuate, and the recesses of each pivot socket substantially coincide with a common circle.

8. A concentrator as set forth in claim 7 in which said housing, pivot sockets and detents are molded as a single unit.

9. A concentrator as set forth in claim 8 in which said detents are V shaped.

10. A concentrator as set forth in claim 6 in which said detents are parallel to each other.

* * * * *